US009838797B2

(12) United States Patent
Jiang et al.

(10) Patent No.: US 9,838,797 B2
(45) Date of Patent: Dec. 5, 2017

(54) SPEAKER

(71) Applicant: GOERTEK INC., WeiFang (CN)

(72) Inventors: Chao Jiang, WeiFang (CN); Jianbin Yang, WeiFang (CN); Zhi Li, WeiFang (CN)

(73) Assignee: GOERTEK INC., Weifang (KR)

( * ) Notice: Subject to any disclaimer, the term of this patent is extended or adjusted under 35 U.S.C. 154(b) by 0 days.

(21) Appl. No.: 15/114,329

(22) PCT Filed: May 22, 2014

(86) PCT No.: PCT/CN2014/078101
§ 371 (c)(1),
(2) Date: Jul. 26, 2016

(87) PCT Pub. No.: WO2015/109698
PCT Pub. Date: Jul. 30, 2015

(65) Prior Publication Data

US 2017/0013367 A1 Jan. 12, 2017

(30) Foreign Application Priority Data

Jan. 26, 2014 (CN) ..... 2014 1 0038883

(51) Int. Cl.
*H04R 25/00* (2006.01)
*H04R 9/06* (2006.01)
(Continued)

(52) U.S. Cl.
CPC ..... *H04R 9/063* (2013.01); *H04R 1/2803* (2013.01); *H04R 1/323* (2013.01); *H04R 7/127* (2013.01); *H04R 7/18* (2013.01); *H04R 9/025* (2013.01)

(58) Field of Classification Search
CPC ..... H04R 9/063; H04R 7/127; H04R 1/323; H04R 1/2803; H04R 7/18; H04R 9/025
(Continued)

(56) References Cited

U.S. PATENT DOCUMENTS 4,039,044 A * 8/1977 Heil ..... H04R 1/02 181/144
2009/0190791 A1* 7/2009 Unruh ..... H04R 9/063 381/398

FOREIGN PATENT DOCUMENTS

CN 1977564 A 6/2007
CN 201904916 U 7/2011
(Continued)

OTHER PUBLICATIONS

International Search Report for International Patent Application No. PCT/KR2014/078101 filed May 22, 2014.
(Continued)

*Primary Examiner* — Sean H Nguyen

(57) ABSTRACT

A speaker comprises at least four diaphragms, inner connecting rods, outer connecting rods, and a cavity sealing housing. Diaphragms spaced apart from each other respectively form a set of diaphragms. The two sets of diaphragms move relative to each other. Connecting points are provided on rigid domes of each of the diaphragms. The inner connecting rods are connected to the diaphragms via the connecting points on the domes. The inner connecting rods respectively connected to the two sets of diaphragms are connected one to another via different outer connecting rods. Cavities of the speaker are formed between adjacent diaphragms. Cavities spaced apart from each other jointly form a front acoustic cavity. The cavities adjacent to the front acoustic cavity form a rear acoustic cavity. The cavity sealing housing seals the front acoustic cavity/rear acoustic
(Continued)

cavity, thus allowing separation of the front and rear acoustic cavities of the speaker.

9 Claims, 2 Drawing Sheets

(51) Int. Cl.

| | |
|---|---|
| ***H04R 7/18*** | (2006.01) |
| ***H04R 1/32*** | (2006.01) |
| ***H04R 9/02*** | (2006.01) |
| ***H04R 1/28*** | (2006.01) |
| ***H04R 7/12*** | (2006.01) |

(58) Field of Classification Search
USPC ..... 381/186
See application file for complete search history.

(56) References Cited

FOREIGN PATENT DOCUMENTS

| | | | |
|---|---|---|---|
| CN | 103269471 | A | 8/2013 |
| CN | 103813245 | A | 5/2014 |
| CN | 203708479 | U | 7/2014 |
| EP | 0 771 133 | A1 | 5/1997 |

OTHER PUBLICATIONS

Office Action from Korean Patent Office for Application No. 10-2016-7022215 dated Mar. 9, 2017.

* cited by examiner

SPEAKER

CROSS-REFERENCE TO RELATED APPLICATIONS

The present specification is a U.S. National Stage of International Patent Application No. PCT/CN2014/078101 filed May 22, 2014, which claims priority to and the benefit of Chinese Patent Application No. 201410038883.5 filed in the Chinese Intellectual Property Office on Jan. 26, 2014, the entire contents of which are incorporated herein by reference.

FIELD OF THE INVENTION

The present invention relates to the acoustics field, more specifically, to a speaker.

BACKGROUND

As a sound production device with good bass characteristic, a bass loudspeaker is increasingly widely used in daily life. In product design, since enough acoustical power is required to be radiated at a low-frequency stage, and the area of the diaphragm and the volume of the whole product are relatively large, when applied to thin type electronic device, such as liquid crystal televisions, laptop computer and the like, it is required to reduce the dimension in one direction on the basis of ensuring the performance of the loudspeaker so as to meet the need of thin type electronic device.

In order to decrease the resonant frequency of the speaker and improve the sensitivity of the speaker, generally, a plurality of diaphragms are used in one speaker, and the diaphragms are connected with one another through a connecting rod, thereby achieving the optimization of acoustic-electric transition. However, in the manufacturing process of the existing speaker, the connecting rods have to penetrate the diaphragms so as to achieve the connection between the diaphragms, which may inevitably result in air leakage, and once air leaks, it will result in poor sound quality, such as distortion of sound, or noise and the like, which will further influence the sound effects of the speaker.

SUMMARY OF THE INVENTION

In view of the above problems, one objective of the present invention is to provide a speaker for solving the problem of air leakage at the diaphragms while decreasing the resonant frequency of the speaker, improving sensitivity and decreasing the difficulty in manufacture of the speaker.

Provided in the present invention is a speaker comprising at least four diaphragms, inner connecting rods, outer connecting rods, and a cavity sealing housing; wherein all the diaphragms form two groups of the diaphragms, and the diaphragms of the two groups are alternately arranged, and the two groups of the diaphragms move relative to each other; connecting points are provided on DOMEs of each of the diaphragms, respectively, and the inner connecting rods are connected with the diaphragms via the connecting points on the domes, and the inner connecting rods, which are connected with the two groups of diaphragms, respectively, are connected with each other via different outer connecting rods, respectively; cavities of the speaker are formed between adjacent diaphragms, and cavities that are spaced apart from each other jointly form a front acoustic cavity of the speaker, and the cavities adjacent to the front acoustic cavity form a rear acoustic cavity of the speaker, and the cavity sealing housing seals the front acoustic cavity or the rear acoustic cavity to separate the front acoustic cavity from the rear acoustic cavity of the speaker.

Wherein the speaker further comprises a driving source, and a number of the diaphragms is four, and the driving sources are located at both ends of the speaker, and the cavity sealing housing is disposed on the rear acoustic cavity.

Wherein the inner connecting rods comprise short connecting rods and long connecting rods, and each of the diaphragms is connected with a group of the short connecting rods or the long connecting rods, and the short connecting rods and the long connecting rods are staggered with each other in each of the two groups of the diaphragms.

Wherein both the inner connecting rods and the outer connecting rods are divided into two groups, respectively.

Wherein the short connecting rods are connected to the diaphragms within 0~¼ of the length in major axis direction of the DOMEs of the diaphragms, and the long connecting rods are connected to the diaphragms within ¼~½ of the length in the major axis direction of the DOMEs of the diaphragms.

Wherein the diaphragms spaced apart from each other form a group of the diaphragms by being connected with each other through the outer connecting rods, and the driving source comprises a magnetic circuit, which is to drive the movement of one group of the diaphragms by being connected with the diaphragm of said one group which is adjacent to the magnetic circuit.

Wherein the driving source is a moving-coil driving source.

Wherein, the driving source is electrically connected with an external circuit through a flexible printed circuit board.

Wherein, center suspensions are provided below the diaphragms which are away from the driving source.

Wherein, the diaphragms are elongated diaphragms.

By using the above speaker according to the present invention, it may ensure that the diaphragms are not required to be penetrated by the connecting rods of the speaker, and thus there is no question of sound leakage, and acoustic performance is further improved, and the level of difficulty in manufacture is lowered. In addition, the installation position of the center suspensions are away from the driving source, the polarization of the diaphragms can be more effectively suppressed.

In order to achieve the above and related objectives, one or more aspects of the present invention comprise the features detailed below and indicated particularly in the claims. Some exemplary aspects of the present invention are described in details by the description below and the accompanying drawings. However, these aspects only indicate some implementations of various implementations of the present invention. In addition, the present invention is intended to contain these aspects and the equivalents thereof.

BRIEF DESCRIPTION OF DRAWINGS

By referring to the descriptions of the accompanying drawings and the claims, and with a full understanding of the present invention, other purposes and results of the present invention will be more clearly and easily understood. In the drawings:

Figure 1:
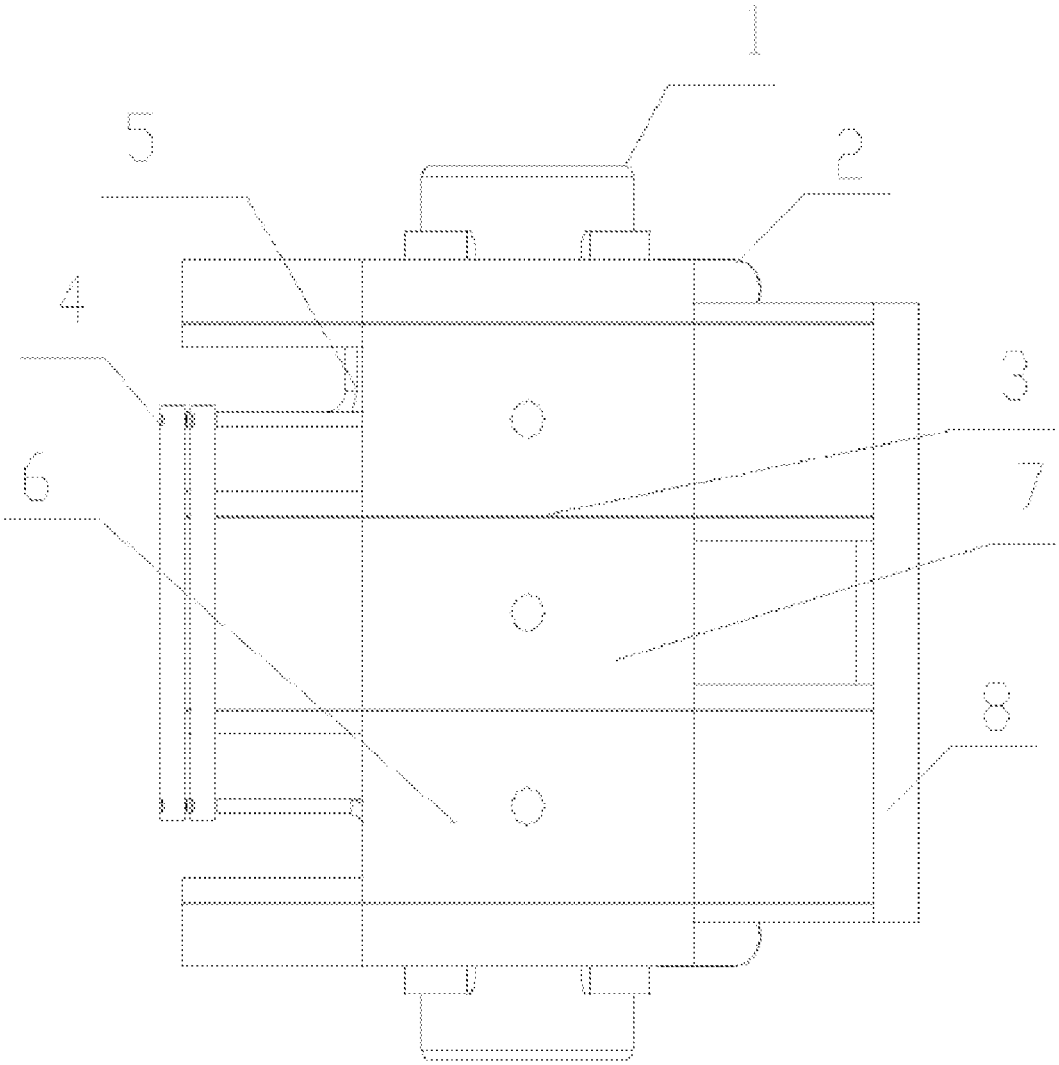
FIG. 1 is a schematic view illustrating the section structure of the speaker with four diaphragms according to the embodiment of the present invention.

Wherein the reference numerals comprise: magnetic circuit 1, FPCB 2, diaphragms 3, outer connecting rods 4, inner connecting rods 5, the first housing 6, the second housing 7, cavity sealing housing 8, and center suspension 10.

The same reference numerals in all figures indicate similar or corresponding features or functions.

DETAILED DESCRIPTION OF EMBODIMENTS OF THE INVENTION

Various specific details are group forth in the following description to provide a comprehensive understanding of one or more embodiments for sake of illustration. However, it is obvious that these embodiments can be implemented without the specific details. Specific embodiments of the present invention will be described with reference to the accompanying drawings.

In the following descriptions, the rigid portion in the center of the diaphragm (rigid center portion) is referred to as "DOME" uniformly in the following description of the specific embodiment of the present invention for sake of illustration.

The bass loudspeakers are required to have a larger diaphragm area. In order to provide a larger diaphragm area on the basis of limiting the sizes of the voice coil and the magnets, the speaker according to the present invention embarks from being arranged with multiple diaphragms, and the diaphragms are made to be connected with each other without being penetrated by the inner connecting rods and outer connecting rods, thereby resolving the problem of air leakage and improving the acoustical behavior of the speaker.

FIG. 1 is a schematic view illustrating the section structure of the speaker with four diaphragms according to the embodiment of the present invention.

As illustrated in FIG. 1, the speaker in the present invention comprises diaphragms 3, FPCB 2, inner connecting rods 5, outer connecting rods 4, magnetic circuit 1 and cavity sealing housing 8. Wherein, the diaphragm comprises DOME and a suspension ring portion. There are four elongated diaphragms 3, which are in parallel with each other. The four diaphragms form two groups of diaphragms, and the diaphragms of the two groups of diaphragms are alternately arranged and the two groups of diaphragms move relative to each other, and the four diaphragms consists of the first diaphragm, the second diaphragm, the third diaphragm and the fourth diaphragm (from the bottom up). The DOMEs of each diaphragm are provided with connecting points, and the inner connecting rods 5 are connected with the diaphragms 3 via the connecting points in the direction of the major axis of DOMEs, and the inner connecting rods 5 connected with two groups of diaphragms, respectively, are connected with each other via different outer connecting rods 4, respectively. Specifically, the inner connecting rods 5 connected with the first and the third diaphragms are connected with each other via one outer connecting rod 4, and the inner connecting rods 5 connected with the second and the fourth diaphragms are connected with each other through another outer connecting rod 4. It should be noted that the specific shape of the elongated diaphragms is not limited, and may be designated and used according to specific requirements.

Cavities of the speaker are formed between adjacent diaphragms. The cavities that are spaced apart from each other jointly form a front acoustic cavity of the speaker. The cavity adjacent to the front acoustic cavity forms a rear acoustic cavity of the speaker. The cavity sealing housing seals the front acoustic cavity/rear acoustic cavity and separates the front cavity from the rear cavity Wherein the cavity sealing housing is arranged on the cavity positioned in the middle and formed of the diaphragms. Preferably, when there are four diaphragms, the cavity positioned in the middle is the rear acoustic cavity.

The speaker provided by the present invention further comprises a driving source, which may be a moving-coil driving source. The working principle of the moving coil is that a closed coil in the magnetic field may generate electricity when the magnetic flux through the closed coil varies, or vice versa. The magnetic field generated by the current flowing through the coil interacts with the permanent magnet material positioned at the bottom so as to push the vibration of the diaphragms, thereby producing sound.

Particularly, connecting points on one diaphragm 3 are provided on the major axis of the DOME of the diaphragm. The diaphragms 3, which are numbered with an odd number, are connected with the inner connecting rods 5 via the connecting points, and then all the diaphragms 3, which are connected with the inner connecting rods 5 and are numbered with an odd number, are connected with each other via the outer connecting rods 4, thus forming the first group of diaphragms, and wherein, the inner connecting rods 5 comprise short connecting rods and long connecting rods, and the short connecting rods and the long connecting rods are staggered with each other in the first group of diaphragms.

Wherein, the connecting points on the diaphragm are arranged in the direction of the major axis of the DOME of the diaphragm, and there may be two connecting points, or one connecting point. In the case of two connecting points, the installation of the inner connecting rods is symmetrical with that of the outer connecting rods. In addition, in the case of one connecting point (i.e., using the connecting rods at one side) while guarantying the normal work of the diaphragms, each diaphragm is connected with one inner connecting rod, thereby saving raw material and reducing the weight of the speaker.

In addition, the diaphragms 3 which are numbered with an even number are connected with the inner connecting rods 5 via the connecting points, and then all the diaphragms 3, which are connected with the inner connecting rods 5 and are numbered with an even number, are connected with each other via the outer connecting rods 4, thus forming the second group of diaphragms. Wherein, the short connecting rods and the long connecting rods of the inner connecting rods 5 are staggered in the second group of diaphragms.

Since the working principle of the speaker is to produce sound mainly by the vibration of the diaphragms 3, and however, the diaphragms 3 may have some non-piston vibration modes while vibrating, putting the connecting rods at different positions of the DOMEs of the diaphragms can effectively suppress swing mode and bending vibration mode of the diaphragms.

It should be noted that in the case that the inner connecting rods 5 are in pairs, the number of pairs is the same as that of the diaphragms 3. As an example, if six diaphragms 3 are used in one speaker, the number of pairs of the inner connecting rods is six. Meanwhile, the outer connecting rods 4 are in pairs as well, i.e., the number of pairs of the outer connecting rods may be two. In the present invention, as the diaphragms are divided into groups based on whether the diaphragms is numbered with an even number or an odd number, and thus the diaphragm 3 are divided into two groups, and thus the outer connecting rods 4 are divided into two groups as well. In the case of using unilateral rods (i.e., using the connecting rods at one side), the number of the inner connecting rods depends on the number of the diaphragms, and the outer connecting rods, as one group, are connected with the inner connecting rods which are connected with diaphragms of different groups, respectively.

Since the front cavity is in communication with the rear cavity of the speaker due to the use of the connecting rods 4, a cavity sealing housing 8 has to be added, which is positioned on the cavity in the middle. Specifically, the cavity sealing housing 8 is mounted at the position where the outer connecting rods 4 are connected with the inner connecting rods 5 located at the front cavity of the speaker, thus separating the front cavity from the rear cavity of the speaker.

In addition, in order to reduce the polarization amplitude of the diaphragms of the speaker, center suspensions 10 are provided below the diaphragms away from the driving source. There are two center suspensions 10 which are positioned below two diaphragms of each group of the diaphragms away from the driving source, respectively, and compared with the case that the center suspensions 10 are positioned below the diaphragms close to the driving source, the polarization of the diaphragms is more effectively suppressed.

In the specific embodiment of the speaker according to the present invention, the driving source comprises magnetic circuits and voice coils, wherein the magnetic circuit 1 are in pairs and there is at least one group of magnetic circuits which are arranged below the first diaphragm and above the fourth diaphragm, respectively, and are connected with the DOMEs of two adjacent diaphragms 3 via a voice coil bobbin. It should be noted that in case that the inner space of the speaker is enough, multiple groups of magnetic circuits 1 may be provided for jointly driving the diaphragms, thereby effectively suppressing the polarization of the diaphragms, improving sensitivity, and meanwhile, reducing costs as well due to size reduction of the magnetic of the magnetic circuits.

The FPCB 2 provided for connecting the leading wire of the voice coil with the housing is in a long strip shape in the specific embodiment of the speaker according to the present invention, and a circuit is arranged on its end for connecting with external circuits, and pads are arranged at one end of the FPCB 2. The voice coil leading wire of the voice coil is bonded to the DOME of the diaphragm 3 close to the magnetic circuit 1 and is connected to one end of the FPCB 2 via the pads, and the other end of the FPCB 2 is connected with the relevant housing, and then connected with external circuits. Both ends of the FPCB 2 are bent in the form of an arc structure until being parallel with the mounting surface, and when the FPCB 2 has such a structure, the internal space of the bass loudspeaker can be fully used, and disconnection due to traction of lead wires during the vibration of the vibrating diaphragm can be avoided.

On the basis of the above structure, the working principle of the speaker according to the present invention is as follows:

The magnetic circuit at one end of the speaker drives the movement of the diaphragm connected thereto. Since the DOME of the diaphragm is connected with the inner connecting rod via the connecting point thereon, and meanwhile, the inner connecting rod is connected with the corresponding outer connecting rod, a plurality of diaphragms spaced from the diaphragm also move, and more specifically, move in the same direction as that of the diaphragm and with the same amplitude. Similarly, the magnetic circuit at the other end of the speaker also drive the movement of the diaphragm adjacent thereto, and a plurality of diaphragms spaced apart from the diaphragm also move, and move in the same direction as that of the diaphragm and with the same amplitude by connecting the inner connecting rods with the outer connecting rods. The movements between the adjacent diaphragms are relative so as to produce sound and lower resonant frequency of the speaker, thereby achieving better bass effects.

Particularly, there are four diaphragms 3 in the specific embodiment of the speaker according to the present invention, which are defined as, from the bottom up, the first diaphragm, the second diaphragm, the third diaphragm and the fourth diaphragm, respectively. Wherein, the first diaphragm and the third diaphragm are connected with each other via one outer connecting rod 4 at one side of the four diaphragms, and the second diaphragm and the fourth diaphragm are connected with each other via another outer connecting rod at another corresponding side and in the same manner as that of the first diaphragm and the third diaphragm. The inner connecting rods 5, which are connected with the diaphragms 3 connected to the same outer connecting rod 4, are arranged to alternate with long and short, that is, when the inner connecting rod 4 connected to the first diaphragm is a short connecting rod, and the inner connecting rod 4 connected to the third diaphragm is a long connecting rod. In addition, the short connecting rod connected to the first diaphragm is connected to the diaphragms within 0~¼ of the length in the major axis direction of the DOME 2 of the first diaphragm, and the long connecting rod connected to the second diaphragm is connected to the diaphragms within ¼~½ of the length in the major axis direction of the DOME 2 of the second diaphragm, and with regard to the third and fourth diaphragms, it is similar with the first and the second diaphragms. Putting the inner connecting rods in different places can effectively suppress swing mode and bending vibration mode of the diaphragms.

In order to decrease the resonant frequency of the speaker and improve the sound quality and sensitivity of the speaker, a plurality of diaphragms 3 may be utilized in one speaker, and the number of the diaphragms may be an even number, and may be an odd number as well. Only four diaphragms are taken as an example in the above embodiment. Similarly, more diaphragms may be utilized in one speaker so as to increase effective radiating area, decrease the resonant frequency of the speaker and improve the sensitivity of the speaker.

In order to ensure that the front acoustic cavity is separated from the rear acoustic cavity, in one specific embodiment of the present invention, the housings for corollary use are required to be mounted. Wherein, in the embodiment of the present invention, the first housing 6 is of a racetrack shape, and one 180° opening and one 90° opening are provided on the arcs at both ends thereof, respectively, and the second housing 7 is of a racetrack shape, and one 90° opening is provided on the arc at one end thereof. The three housing are mounted in the order of the first housing 6, the second housing 7 and the first housing 6. Wherein, the 180° openings and the 90° openings of a pair of the first housings 6 correspond to each other, respectively, and the 90° opening of the second housing 7 and the 90° openings of the first housings 6 are staggered with each other. The second housing 7 forms a small rear acoustic cavity of the speaker, and a pair of the first housings 6 jointly form front cavity of the speaker, and the openings of the first housings 6 correspond to each other, and the sound are let out via the two 180° openings.

The cavities spaced apart from each other, i.e., cavities formed by the first housings 6, form the front acoustic cavity, and the second housing 7 forms the rear acoustic cavity. In order to separate the front acoustic cavity from the rear acoustic cavity of the speaker, a cavity sealing housing 8 is mounted at the outer side of the outer connecting rods 4 on one side. Specifically, the installation of the rear cavity housing enables the whole speaker to form a large rear cavity, and due to the use of the outer connecting rods 4, the front cavity of the speaker is in communication with the large rear cavity, and therefore, the cavity sealing housing 8 is required to be mounted to separate the front cavity from the rear cavity.

Figure 2:
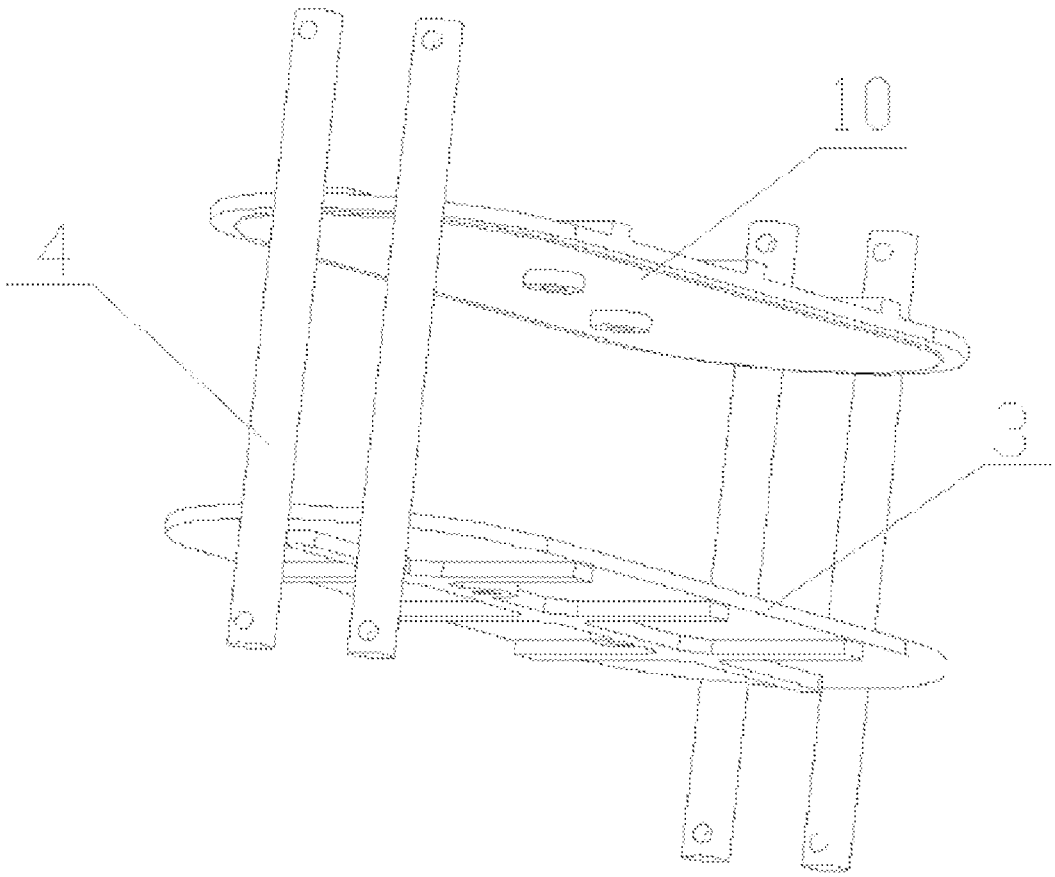
FIG. 2 is a schematic view illustrating the structure of the center suspension of the speaker according to the embodiment of the present invention.

In addition, in order to reduce the polarization amplitude of the diaphragms of the speaker, center suspensions 10 are provided below the second diaphragm and the third diaphragm respectively, and FIG. 2 shows the structure of the center suspensions according to the embodiment of the present invention. As shown in FIG. 2, the center suspensions 10 are connected with the DOME 2 of the diaphragm 3 thereon. Since compared with the first and fourth diaphragms, the second and third diaphragms are further away from the driving magnetic circuit, the inhibition effect of the polarization of the speaker will be more obvious.

The magnetic circuits 1 serving as the driving source according to the embodiment are of one group and fixed via mounting holes provided on the housing, and each of the magnetic circuits 1 is connected with the DOME 2 of its adjacent diaphragm via the voice coil bobbin, that is, a group of magnetic circuits 1 are connected with the DOMEs of the first diaphragm and the fourth diaphragm respectively. In the embodiment of the present invention, the FPCB is used to electrically connected with the driving unit and the external circuits, and compared with common connecting mode which uses the leading wires, he present invention can simplify the manufacturing process, save the internal space of the loudspeaker and improve the stability of the loudspeaker by using the FPCB.

It should be noted that multiple groups of magnetic circuits 1 may be provided, and used as driving sources by using different forms of series connections, parallel connections or the combination thereof so as to effectively suppress polarization of the diaphragms 3 and improve the sensitivity, and meanwhile, to lower the cost due to the reduction of the volume of the magnet in the magnetic circuits.

As can be seen from the above embodiments, in the speaker provided by the present invention, the diaphragms are connected with each other by using the inner and outer connecting rods, and the diaphragms are not required to be penetrated, thus there is no question of sound leakage, and acoustic performance is further improved, and the level of difficulty in manufacture is lowered. In addition, the installation position of the center suspensions are away from the driving source, the polarization of the diaphragms can be more effectively suppressed.

As described above, the speaker of the present application is described by way of example with reference to the accompanying drawings. However, it should be understood by those skilled in the art that various improvements can be made to the speaker provided by the present invention as described above without departing from the contents of the present invention. Accordingly, the protection scope of the present invention is determined by the contents of the appended claims.

What is claimed is:

1. A speaker comprising at least four diaphragms, inner connecting rods, outer connecting rods, and a cavity sealing housing, wherein all the diaphragms forms two groups of the diaphragms, and the diaphragms of the two groups are alternately arranged, and the two groups of the diaphragms move relative to each other; connecting points are provided on rigid domes of each of the diaphragms, respectively, and the inner connecting rods are connected with the diaphragms via the connecting points on the rigid domes, and the inner connecting rods, which are connected with the two groups of diaphragms, respectively, are connected with each other via different outer connecting rods, respectively;

cavities of the speaker are formed between adjacent diaphragms, and cavities that are spaced apart from each other jointly form a front acoustic cavity of the speaker, and the cavities adjacent to the front acoustic cavity form a rear acoustic cavity of the speaker, and the cavity sealing housing seals the front acoustic cavity or the rear acoustic cavity to separate the front acoustic cavity from the rear acoustic cavity of the speaker, wherein the speaker further comprises driving sources, the driving sources being located at both ends of the speaker, each of the two groups of the diaphragms corresponding to a driving source among the driving sources, and wherein center suspensions are provided on a selected diaphragm among each of the two groups of the diaphragms that is the furthest away from the corresponding driving source, the center suspensions being disposed on a side of each of the selected diaphragms that faces the corresponding driving source.

2. The speaker according to claim 1, wherein a number of the diaphragms is four and the cavity sealing housing is positioned on the rear acoustic cavity.

3. The speaker according to claim 2, wherein the driving source comprises a magnetic circuit, which is to drive the movement of one group of the diaphragms by connecting with the diaphragm of the one group which is adjacent to the magnetic circuit.

4. The speaker according to claim 1, wherein the inner connecting rods comprise short connecting rods and long connecting rods, and each of the diaphragms is connected with a group of the short connecting rods or a group of the long connecting rods, and the short connecting rods and the long connecting rods are staggered with each other in each of the two groups of the diaphragms.

5. The speaker according to claim 4, wherein both the inner connecting rods and the outer connecting rods are divided into two groups, respectively.

6. The speaker according to claim 5, wherein each of the short inner connecting rods is connected to each of the diaphragms in a region within 0 to ¼ of a length of a major axis of the rigid dome of each of the diaphragms, and each of the long connecting rods is connected to each of the diaphragms in a region within ¼ to ½ of the length of the major axis of the rigid dome of each of the diaphragms.

7. The speaker according to claim 1, wherein the driving source is a moving-coil driving source.

8. The speaker according to claim 7, wherein the driving source is electrically connected with an external circuit through a flexible printed circuit board and the flexible printed circuit board is bent in a form of an arc structure until being parallel with a mounting surface thereof.

9. The speaker according to claim 1, wherein the diaphragms are elongated diaphragms.

* * * * *